US005685512A

United States Patent [19]

Yang

[11] Patent Number: 5,685,512

[45] Date of Patent: Nov. 11, 1997

[54] DISPLAY DEVICE CAPABLE OF SUPPORTING AN ARTICLE OF DIFFERENT SIZE THEREON

[75] Inventor: Huan-Bin Yang, Kweishan, Taiwan

[73] Assignee: Acer Peripherals Inc., Taoyuan, Taiwan

[21] Appl. No.: 608,289

[22] Filed: Feb. 28, 1996

[51] Int. Cl.[6] ..... A47F 5/00

[52] U.S. Cl. ..... 248/298.1; 403/109; 312/205; 211/94.5

[58] Field of Search ..... 248/298.1, 95, 248/99, 292.13, 424; 403/109, 377, 373; 312/205, 350, 281, 330.1; 211/94.5, 94, 106

[56] References Cited

U.S. PATENT DOCUMENTS 5,433,551 7/1995 Gordon ..... 403/109 X

*Primary Examiner*—Leslie A. Braun

*Assistant Examiner*—Long Dinh Phan

*Attorney, Agent, or Firm*—Meltzer, Lippe, Goldstein et al.

[57] ABSTRACT

A display device with article support device thereon is provided. The article support device is elongatable to cope with different size of the article. The display device has a casing which defines an inside which is space within the casing and an outside which is space not within the casing. The display device comprises a rear casing having two passages. The support device comprises an elongatable frame and a retainer which passes through the passage and is connected to the rear casing by a first screw. The retainer has a first end on which a pressure exertion apparatus is provided. The pressure exertion apparatus is accessible from outside. A thread is provided at the pressure exertion apparatus and cooperates with a second screw. The retainer and the second screw have a hole for passage of the elongatable frame which is positioned and unable to move when the second screw is screwed to tighten the pressure exertion apparatus. The elongatable frame is released and able to move when the second screw is unscrewed to release the pressure exertion apparatus.

1 Claim, 4 Drawing Sheets

DISPLAY DEVICE CAPABLE OF SUPPORTING AN ARTICLE OF DIFFERENT SIZE THEREON

TECHNICAL FIELD OF INVENTION

This invention relates to a display device which can support an article thereon by an elongatable frame.

BACKGROUND OF INVENTION

With the advent of large size display device into the market, the user of such display device often places the auxiliary device, i.e. laser disc player, over the top flat surface of the display device. Doing so may save space occupied by the auxiliary device otherwise.

However, the exterior design of the top surface of the display device may restrict the size of the article placed. In an event of a laser disc of larger size, its placement over the top surface of the display device may have a stability problem. When instability occurs, the sophisticate machine will definitely be damaged.

To the above concern, this invention provides a display device which can support an article of different size thereon without the instability concern.

SUMMARY OF INVENTION

A display device with article support device thereon is provided. The article support device is elongatable to cope with different size of the article.

The display device has a casing which defines an inside which is space within the casing and an outside which is space not within the casing. The display device comprises a rear casing having two passages. The display device comprises device for supporting an article thereon. The support device comprises an elongatable frame and a retainer which passes through the passage and is connected to the rear casing by a first screw.

The retainer has a first end on which a pressure exertion apparatus is provided. The pressure exertion apparatus is accessible from outside.

A thread is provided at the pressure exertion apparatus and cooperates with a second screw. The retainer and the second screw have a hole for passage of the elongatable frame which is positioned and unable to move when the second screw is screwed to tighten the pressure exertion apparatus.

The elongatable frame is released and able to move when the second screw is unscrewed to release the pressure exertion apparatus.

When not used, the support device can be pushed into the inside of the casing and does not occupy any outside space over the display device.

BRIEF DESCRIPTIONS OF DRAWINGS

DETAILED DESCRIPTION OF THE PREFERRED EMBODIMENT

Figure 1:
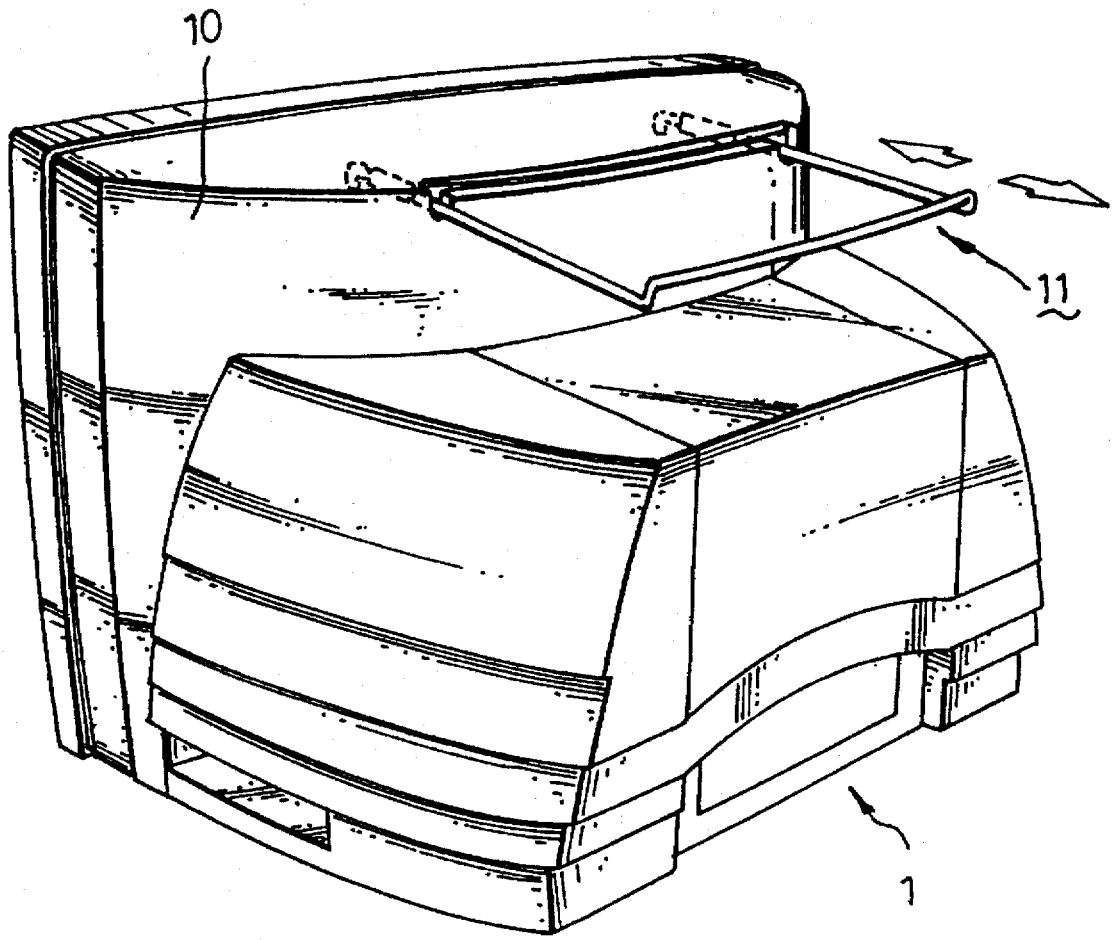
FIG. 1 illustrates the invention when fully elongated.
Figure 2:
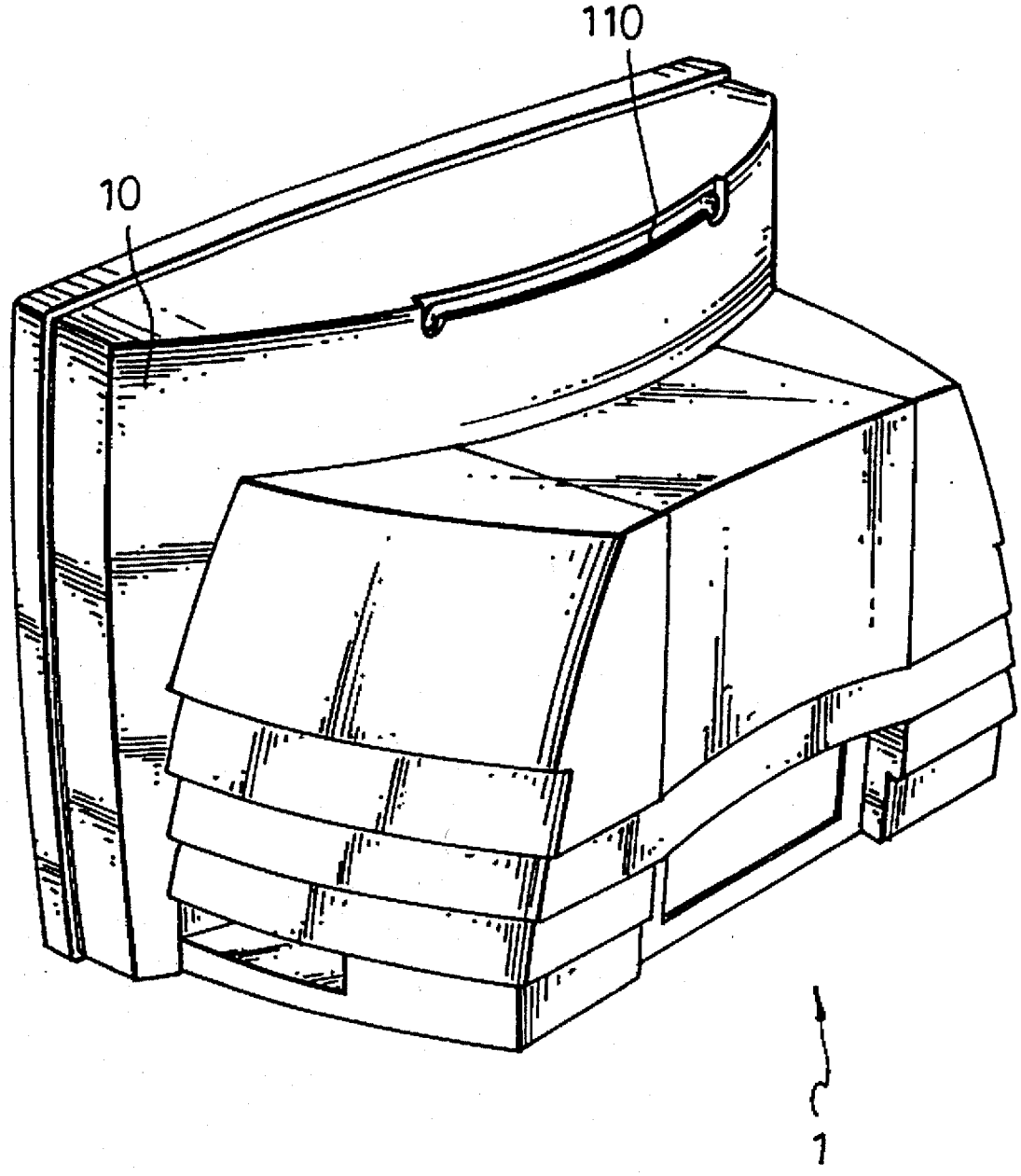
FIG. 2 illustrates the invention when fully abbreviated.

As illustrated in FIG. 1, the display device 1 has a casing which defines an inside which is space within the casing and an outside which is space not within the casing. The display device 1 comprises a rear casing 10 which has two passages and a space for housing a frame 110 of the support device 11, as shown in FIG. 2. The display device comprises device 11 for supporting an article thereon. The support device 11 can be in a fully elongated position shown in FIG. 1 or can be in a fully abbreviated or hidden position shown in FIG. 2.

Figure 3:
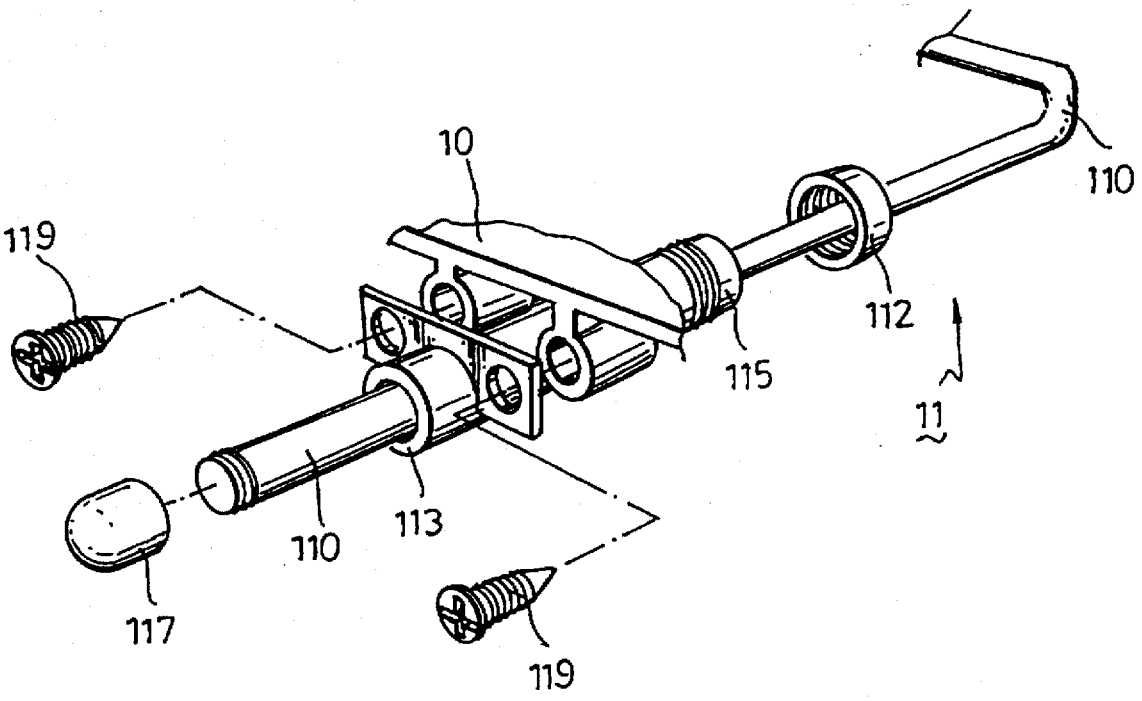
FIG. 3 illustrates the invention in partial assembly and partial explosive view.
Figure 4:
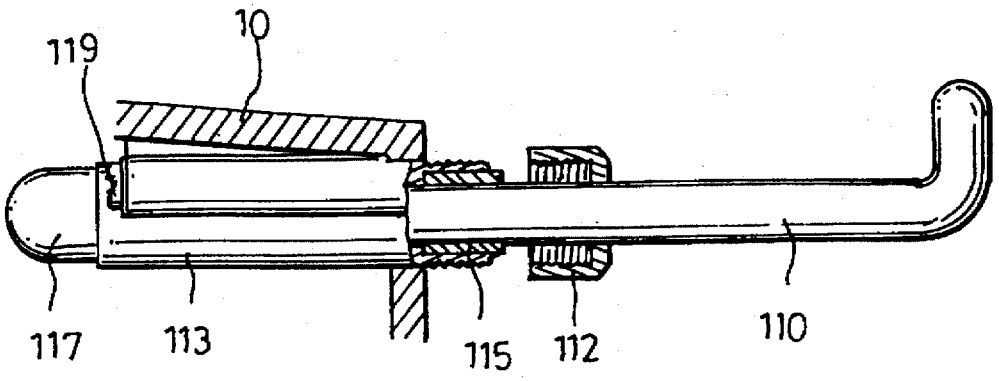
FIG. 4 illustrates the invention in sectional view.
Figure 5:
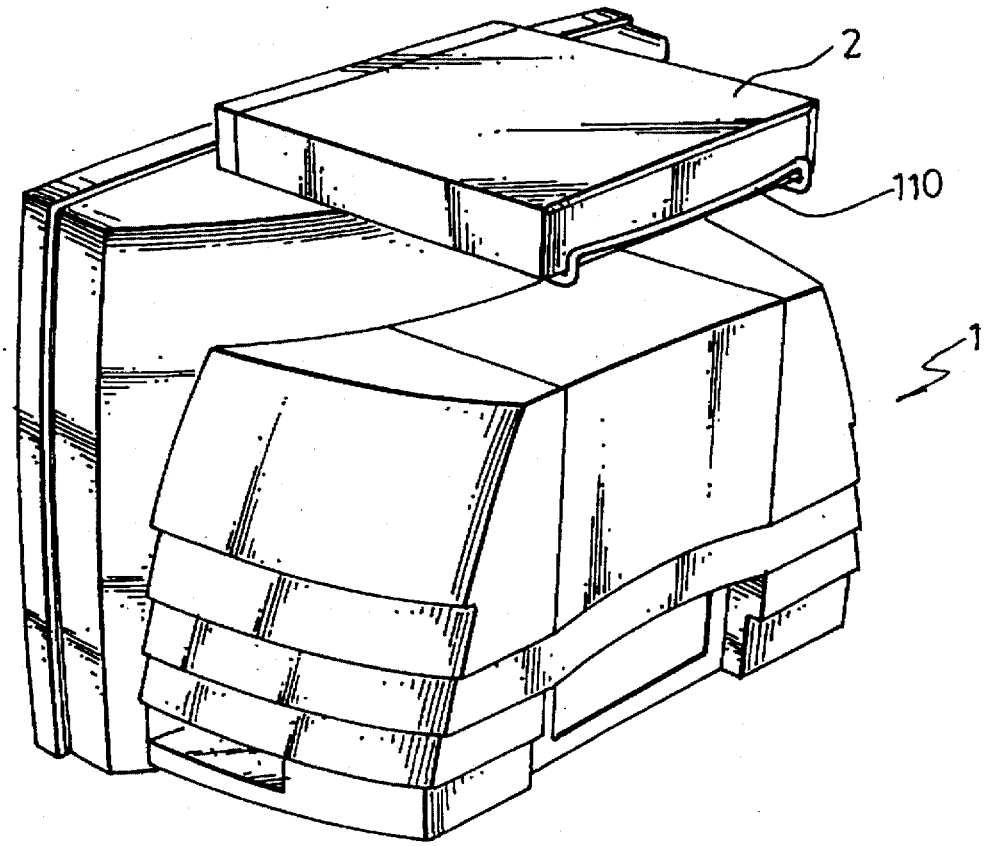
FIG. 5 illustrates an article is placed over the support device of the invention.

As illustrated in FIGS. 3 and 4, the support device 11 comprises an elongatable frame 110 and a retainer 113 which passes through the passage of the rear casing 10 and is connected to the rear casing 10 by a first screw 119.

The retainer 113 has a first end on which a pressure exertion apparatus 115 is provided. The pressure exertion apparatus 115 is accessible from outside of the display device 1.

A thread is provided at the pressure exertion apparatus 115 and cooperates with a second screw 112. The retainer 113 and the second screw 112 have a hole for passage of the elongatable frame 110 which is positioned and unable to move when the second screw 112 is screwed to tighten the pressure exertion apparatus 115.

On the other hand, the elongatable frame 110 is released from the pressure exertion apparatus 115 and able to move when the second screw 112 is unscrewed to release the pressure exertion apparatus 115.

When not used, the support device 11 can be pushed into the inside of the casing and does not occupy any outside space over the display device 1.

When used, the support device 11 can be pulled out from the inside of the casing and used as a support device for an article, i.e. an laser disk player 2, over the display device 1.

As shown in FIG. 3, a releasable bolt 117 is provided at the end of the elongatable frame 110 to refrain the elongatable frame 110 from detaching with the retainer 113.

I claim:

1. A display device having a casing, the casing defining an inside which is space within the casing and an outside which is space not within the casing, comprising;

a rear casing having two passages;

means for supporting an article thereon, the support means comprising an elongatable frame and a retainer, the retainer passing through the passage and being connected to the rear casing by a first screw, the retainer having a first end on which a pressure exertion means is provided, the pressure exertion means being accessible from outside, a thread being provided at the pressure exertion means and cooperating with a second screw, the retainer and the second screw having a hole for passage of the elongatable frame, the elongatable frame being positioned and unable to move when the second screw is screwed to tighten the pressure exertion means, and the elongatable frame being released and able to move when the second screw is unscrewed to release the pressure exertion means.

* * * * *